United States Patent [19]

Zeleny

[11] 4,023,599

[45] May 17, 1977

[54] OPTO-ELECTRONIC WEFT YARN DETECTOR

[75] Inventor: Klaus P. Zeleny, Constance, Germany

[73] Assignee: Sulzer Brothers Limited, Winterthur, Switzerland

[22] Filed: Mar. 22, 1976

[21] Appl. No.: 668,926

[30] Foreign Application Priority Data

Mar. 21, 1975 Switzerland ..... 3623/74

[52] U.S. Cl. ..... 139/370.2; 250/548; 250/559

[51] Int. Cl.[2] ..... D03D 51/34; G01N 21/30

[58] Field of Search ..... 139/370.2, 370.1, 435; 28/51; 57/81; 66/163; 250/548, 559

[56] References Cited

UNITED STATES PATENTS

| | | | |
|---|---|---|---|
| 3,489,910 | 1/1970 | Bohme et al. | 139/370.2 |
| 3,608,590 | 9/1971 | Hohener | 139/370.2 |
| 3,802,468 | 4/1974 | Meyer et al. | 139/370.2 |
| 3,824,401 | 7/1974 | Suzuki | 139/370.2 |
| 3,853,408 | 12/1974 | Kaalverink | 139/370.2 |

FOREIGN PATENTS OR APPLICATIONS

| | | | |
|---|---|---|---|
| 2,105,559 | 8/1972 | Germany | 139/370.2 |
| 1,535,398 | 9/1970 | Germany | 139/370.2 |
| 319,653 | 1/1972 | U.S.S.R. | 139/370.2 |
| 335,315 | 5/1972 | U.S.S.R. | 139/370.2 |

*Primary Examiner*—James Kee Chi

*Attorney, Agent, or Firm*—Kenyon & Kenyon Reilly Carr & Chapin

[57] ABSTRACT

The weft yarn detector is used in a weaving machine having pneumatic picking as a stop motion to stop the weaving machine or to operate a warning signal. The detector uses one or more radiation sources to pass radiation across the weft yarn path onto radiation detectors which, in turn, emit signals to a difference amplifier. This amplifier produces signals corresponding to the received patterns of radiation and passes the signals to an evaluator where the signals are compared to a preset value. If the signals do not match or exceed the preset value, the weaving machine is stopped or else a warning signal is produced to indicate a missed pick.

8 Claims, 16 Drawing Figures

OPTO-ELECTRONIC WEFT YARN DETECTOR

This invention relates to an opto-electronic weft yarn detector. More particularly, this invention relates to an opto-electronic weft yarn detector for a weaving machine having a pneumatic picking arrangement.

As is known, gripper shuttle weaving machines have employed opto-electronic weft yarn detectors as stop motions in order to deactivate the machine when a weft yarn is improperly picked or inadvertantly not picked. Generally, these stop motions have been constructed with a transmitting section and a receiving section for radiation directed transversely of the weft yarn picking direction. The receiving section usually has circuit elements which, in the event of a missing or wrong picking, e.g., if the weft yarn is not fully picked or is not stretched, or in the event of a broken weft yarn, initiate stoppage of the weaving machine and/or operate a warning.

Detection of picking is also needed in pneumatic weaving machines. In the event of a missed pick, the machine must be stopped and/or a warning given. The concept of "missed pick" also denotes in the present context a weft yarn which has been picked but which is lying loose in a loop in the weaving shed. It must be remembered in the present context that a weft yarn performs movements which may move it repeatedly outside the sensing or detecting radiation. However, this phenomenon must not be allowed to give the stop motion the impression that a weft yarn is lacking, for if it does the weaving machine will be stopped unnecessarily.

Accordingly, it is an object of the invention to provide a reliable opto-electronic weft yarn detector for a weaving machine employing pneumatic picking.

It is another object of the invention to provide a weft yarn stop motion for dealing with the special conditions associated with weft yarn picking in weaving machines having pneumatic picking.

It is another object of the invention to provide a weft yarn detector which is not disturbed by environmental factors, aging and dirt.

It is another object of the invention to provide weft yarn detector of simple construction and low cost.

Briefly, the invention is based on the recognition that the weft yarns being pneumatically picked in a weaving machine have transverse movement components during picking which are in a particular range of frequencies and amplitudes and that a set value corresponding to a particular kind of weft yarn can be calculated for the number of weft yarn vibrations occurring within a single detection time period. In the event the set value is reached or exceeded, it is highly probable that a weft yarn has been picked. However, if the number of vibrations do not reach the set value, this can be taken as an indication of a missed pick and the weaving machine can be stopped.

In accordance with the invention, the weft yarn detector is made of an opto-electronic type for use as in a weft stop motion in a weaving machine having a pneumatic picking arrangement. This weft yarn detector includes a transmitting section having at least one radiation source for directing radiation transversely of a weft yarn picking direction and a receiving station having an even number of radiation detectors for receiving radiation from the radiation sources and a difference amplifier for producing signals corresponding to the received radiation on the detectors. In addition, the weft yarn detector includes an evaluator for receiving and evaluating the signals produced by the difference amplifier during a given detection time period relative to a preset value and a switching means for selectively stopping the weaving machine or operating a warning signal to stop the machine. This switching means is connected to the evaluator to receive a switching signal therefrom in response to the evaluated signals falling below said preset value.

The presence of an even number of receivers eliminates synchronous errors in the system due to external light effects, temperature variations, interfering electrical signals and voltage fluctuations. Symmetry errors due to component tolerances, aging processes in the system and slight soiling by fluff do not upset evaluation since d.c. components are suppressed.

Preferably, the evaluator includes a switching means for producing a periodic signal during a particular detection time period as well as a comparator which compares the number of signals produced by the difference amplifier with the preset value.

The comparator can have a counter with a resetting input which is connected by way of a single-signal sender to the switching means of the evaluator as well as a counting input which is connected via a gate circuit to the output of the difference amplifier and to the evaluator switching means. The outputs of the counter are connected by way of a gate circuit to the switching means to supply the signal for stopping the machine.

In one embodiment, the evaluator comprises a switching means made ready for operation thereby during a particular period of time and a logical circuit. This logical circuit as embodied by a first AND gate, a single-signal sender, a shift register and a second AND gate. One input of the first AND gate is connected to the output of the switching means while the other input of the first AND gate is connected to the output of the difference amplifier. The output of this AND gate is connected to a shaft timing input of the shift register. The single-signal sender has an input connected to the switching means and an output connected to the shift register resetting input. The outputs of the shift register are connected by way of a preselecting circuit means to one input of the second AND gate, the second input thereof being connected by way of an inverter to the output of the switching means.

The radiation sources and radiation detectors are mounted at the inner periphery of a ring through which the picked weft yarn passes so that each radiation detector receives the radiation of just a single radiation source. The arrangement of the radiation sources and detectors can be such that a radiation source alternates with two radiation detectors around the ring periphery.

These and other objects and advantages of the invention will become more apparent from the following detailed description and appended claims taken in conjunction with the accompanying drawings in which:

FIG. 1 illustrates a block schematic diagram of a weft yarn detector according to the invention used as a weft stop motion;

FIGS. 2*a* to 2*d* are diagrams to explain events in the scheme shown in FIG. 1;

FIG. 3 illustrates a block schematic diagram of a signal evaluator according to the invention;

FIGS. 4*a* to 4*g* are diagrams to explain the system shown in FIG. 3;

Figure 1:
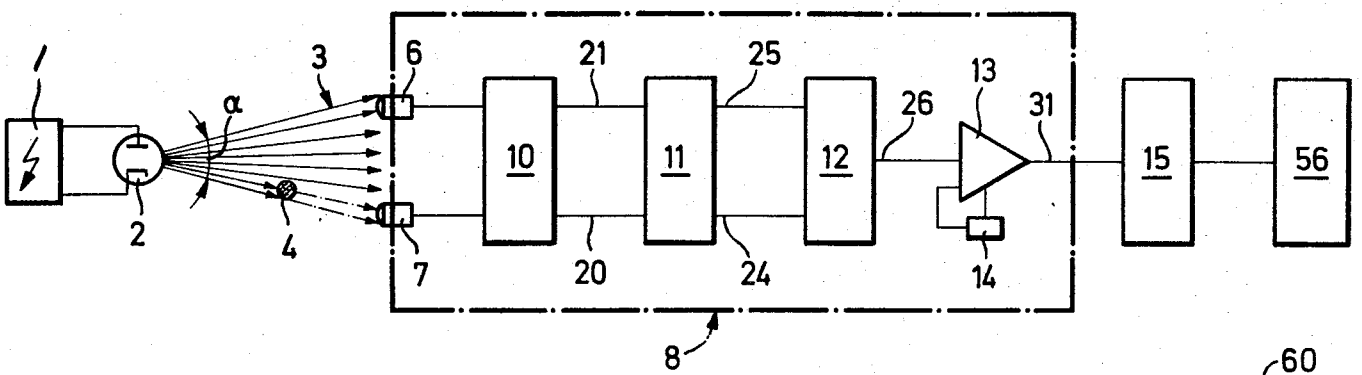

Referring to FIG. 1, the weft yarn detector has a transmitting section including a power supply 1 which outputs a constant current for a radiation source such as a light-emitting diode (LED) 2 which emits a cone 3 of radiation in the form of light transversely of the picking direction (which extends perpendicularly to the plane of the drawings) of a weft yarn 4. A receiving section 8 has a pair of radiation detectors in the form of two photocells 6, 7 as well as a difference amplifier 10 – 14. The radiation detectors 6, 7 form a part of a bridge circuit 10 of the difference amplifier. In addition, the difference amplifier includes a d.c. blocking element 11, an adder 12, an amplifier 13 and a negative feedback network 14 associated with the amplifier 13.

The weft yarn detector also includes an evaluator 15 connected to the difference ampifier 10 – 14 in order to receive and evaluate the signals produced by the difference amplifier 10 – 14 during a given detection time period relative to a preset value. In addition, a switching means 56 is connected to the evaluator 15 for selectively stopping the weaving machine or for operating a warning signal.

The stop motion operates as follows:

When no weft yarn is present in the light cone 3, the light thereof, assuming an appropriate opening angle $\alpha$, is incident on the two photocells 6, 7 at the same intensity. When a picked weft yarn 4 is present in the cone 3, the equilibrium is disturbed. In the position shown in FIG. 1, cell 7 is receiving less light than cell 6 since the weft yarn 4 is reducing the light transmitted. Due to the difference between the intensities of the light received by the two cells 6, 7, an inbalance arises in arm 20 relative to the arm 21 of the bridge circuit 10. Since the wefty yarn 4 performs transverse oscillations in a pneumatic weaving machine, the weft yarn 4 will subsequently shade cell 6 more than cell 7. In this event, arm 21 becomes out of balance relative to arm 20 of the bridge circuit 10. Consequently, signals which are offset in time from one another appear at the end points of the arms 20, 21.

Figure 2A:
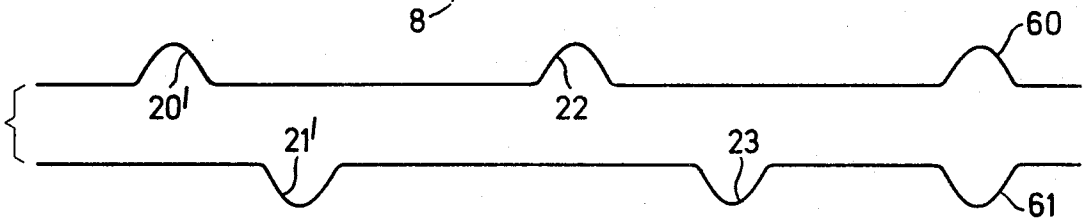

The voltage-time diagrams of FIG. 2*a* show the pattern of the voltages arising at the end points of the bridge-circuit arms 20, 21. Signals 20′, 21′ are produced by weft yarn movement. Other signals 22, 23 are produced by weft yarn movement. The amplitude and shape of the signals depend upon the extent to which the particular photocell concerned is masked.

Figure 2B:
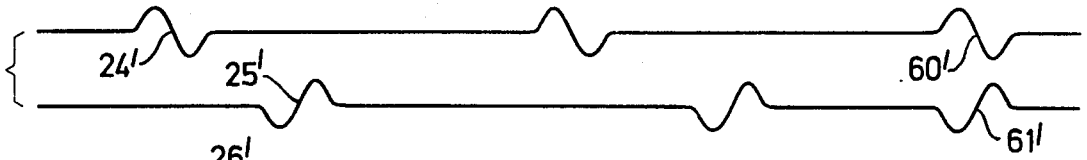
Figure 2C:
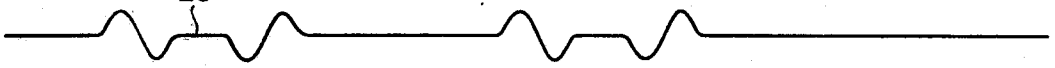
Figure 2D:
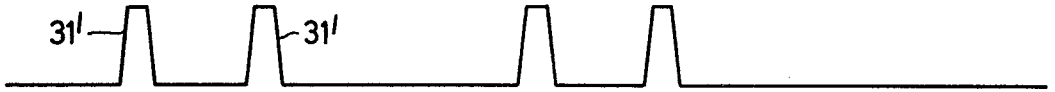

The signals 20′, 21′ are supplied to the d.c. blocking element 11 which at output 24, 25 delivers signals 24′, 25′ as shown in FIG. 2*b*. The signals 24′, 25′ are added together in the adder 12 so that the output 26 thereof delivers a sum signal 26′ (24′ + 25′) (FIG. 2c). The amplifier 13 amplifies the signals 26′ while the negative feedback facility 14 controls the amplifier 13 to operate near saturation conditions. Consequently, the amplifier 13 delivers trapezoidal signals 31′ of the kind shown in FIG. 2*d* at an output 31. The signals 31′ pass to the digital signal evaluator 15 shown in detail in FIG. 3.

The signals 31′ are received and evaluated in the evaluator 15 by being digitally compared in quantity with a preselective set value but only during a particular period of time of the picking step. Signals arriving outside such period of time are neglected.

Figure 3:
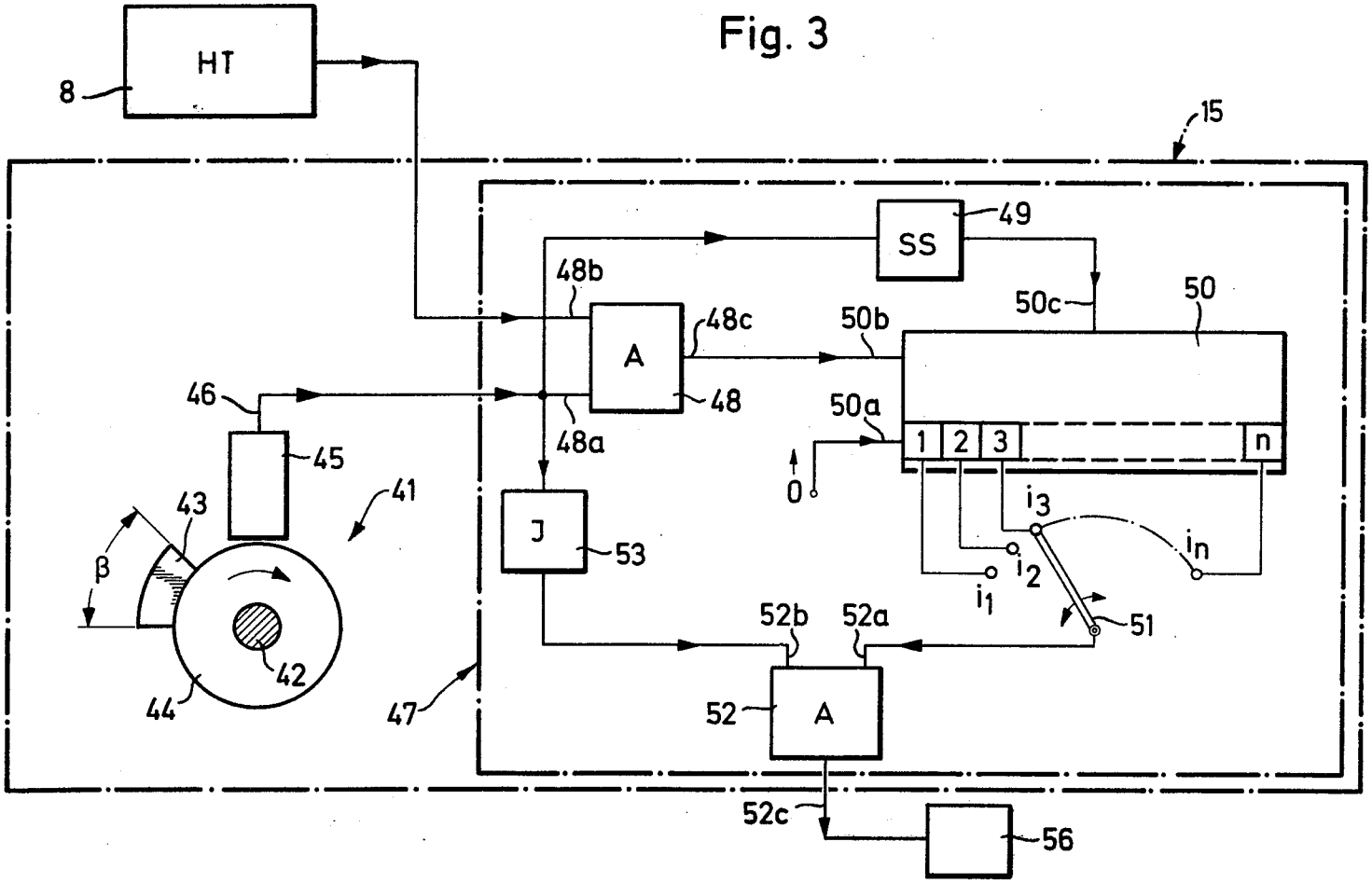
Figures 4A, 4B, 4C, 4D, 4E, 4F, 4G:
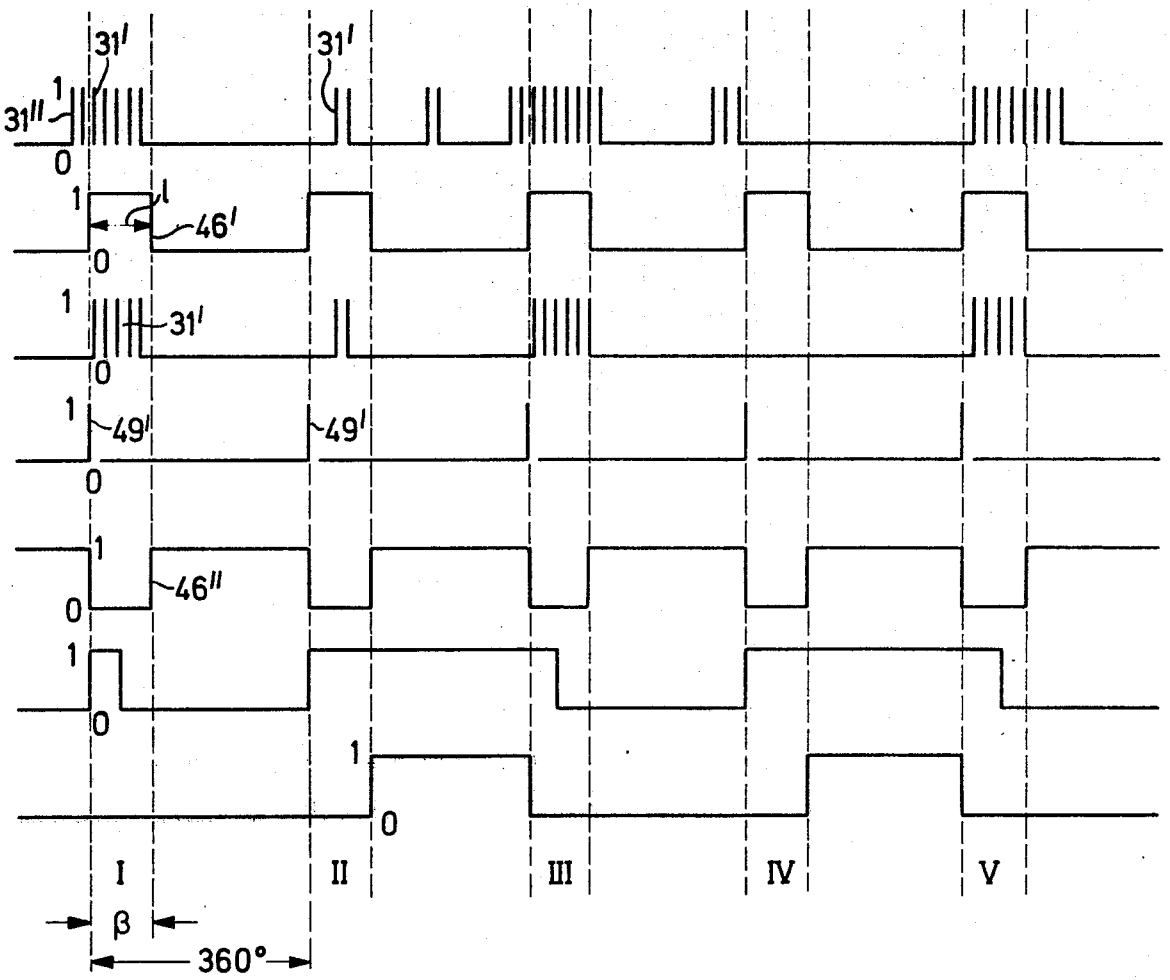

The evaluator 15 is constructed as follows:

In FIG. 3, the receiver 8 of FIG. 1 is shown just as a single block 8 in order to simplify the illustration. A switching means 41 determines the start and end of the detection time period and is embodied by a disc 44 disposed on the main shaft 42 of the weaving machine which has a switching arm or lug or the like 43; and a switching element 45 which cooperates, e.g., inductively, with the disc 44. As shown in FIG. 4*b*, during each revolution of the disc 44, the element 45 produces a signal 46′ at an output 46 over the angular range $\beta$ of the lug 43. This signal 46′ brings a logical circuit 47 to standby, during the length $l$ of the signal 46′. The logical circuit 47 comprises a first AND gate 48, a single-signal sender 49, a shift register (or other counting unit) 50 and preselector circuit means in the form of a switch 51, a second AND gate 52 and an inverter 53. At each start of a detection time period I–IV, the single-pulse switching means 41 produces a needle pulse 49′ at the output as shown in FIG. 4*d*. The shift register 50 comprises $n$ storage cells or stores disposed in consecutive relationship. The inverter 53 inverts the pulses 46′ output by the switching means 41 into pulses 46″ (FIG. 4e). The preselector switch 51 is used to preselect the required set values $i_n$ corresponding to the number of signals 31′ which must be produced as a result of weft yarn movements to ensure that the machine is not stopped. The output 52*c* of the AND gate 52 is connected to the switching means 56 for stopping the machine and/or operating a warning.

The signal evaluator 15 operates as follows:

The logical values of the voltages operative in the circuit are shown in conventional manner in the diagrams of FIG. 4 as 0 and 1. Pulse 46′ is applied to input 48*a* of AND gate 48 during the detection time period I with the value 1. Pulse 46′ also causes sender 49 to produce a needle pulse or resetting pulse 49′ at shift register input 50*c* to cancel the information still present therein from a previous detection step. The trapezoidal signals 31′ produced by the receiver 8 are shown in simplified form as needle pulses in FIG. 4*a*. As a rule, the number of signals for each weft yarn and for each pick will vary. Only signals arising within the pulse 46′ determining the detection period I are evaluated. Consequently, in the case of the first period I considered in FIG. 4*a*, the signals 31″ which arrive before the start of the period I are not processed. When the cancelling pulse 49′ of sender 49 is received in shift register 50, all the outputs $i_1$–$i_n$ take up the 1 value. The AND gate input 52*a* connected to the preselector switch 51 therefore also has the 1 value, as can be seen by reference to FIG. 4*f* which represents the value of the voltage at input 52*a* of gate 52. The shift register data input 50*a* remains at 0. The signals from the receiver 8 are applied consecutively to the AND gate input 48*b* and so since the value at input 48*a* is 1, the signals from the receiver 8 are gated through the AND gate 48 and pass from output 48*c* thereof to enter shift register 50 by way of the shift timing input 50*b*. The first signal 31′ which arrives within the period 1 advances the content 0 of input 50*a* by one cell or store in the register 50. The next signal 31′ reaching the shift register 50 advances the 0 content of input 50*a* by another cell or store, and so on. When the content 0 of the shift register 50 has reached the input $i_3$ to which the preselector switch 51 is set, the set-value number of signals 31' has been reached. This indicates that a weft yarn was present and was picked properly. Gate input 52a receives the value 0 (FIG. 4f). From the termination of period I, the pulse 46' ceases so that the input of inverter 53 is at 0, its output is at 1. Thus, the gate input 52b is also at 1. Since the input 52a is at 0, gate 52 stays closed and does not gate any signal to the switching means 56, i.e., an 37 off" device. Thus, the switching means 56 does not operate and does not stop the weaving machine.

If the shift register content 0 fails to reach the position $i_3$ selected by means of the switch 53, i.e., if an insufficient number of signals 31' was formed during the period 1, this is an indication either that no weft yarn is present or that a weft yarn, if present, was wrongly picked. This situation is shown in connection with detection time period II in which, as can be seen, only two signals 31' have arrived. In this case, the shift register output $i_3$, and therefore the AND gate input 52a, remain at 1 during the period II (FIG. 4f). Upon completion of period II, the AND gate input 52b also becomes 1, so that the same signal is present at the two inputs of the AND gate 52 and the output 52c thereof delivers a signal which operates the switching means 56 to stop the weaving machine. The switching means 56 can also operate some form of warning. FIG. 4g shows the pattern of operations of the switching means 56. As can be gathered, no "off" occured after the periods I, III and V. The switching means 56 operated at the end of periods II and IV because the set-value for the number of signals 31' was not reached in periods II and IV.

A description will now be given of the important property, referred to previously, of being insensitive to disturbances or interference. FIG. 2a shows two interfering or disturbing signals 60, 61 caused for example by external light incident on the receiver photocells 6, 7. FIG. 2b shows the signals 60', 61' after they have passed through the d.c. blocking element 11. Since the two signals are of the same strength and in phase opposition to one another, the adder 12 eliminates them and does not output a signal for them at the output 26. Other disturbing signals in the receiver 8 are similarly eliminated. Consequently, synchronous errors do not reach the evaluator 15 in the stop motion and cannot impair operation thereof.

Figure 5:
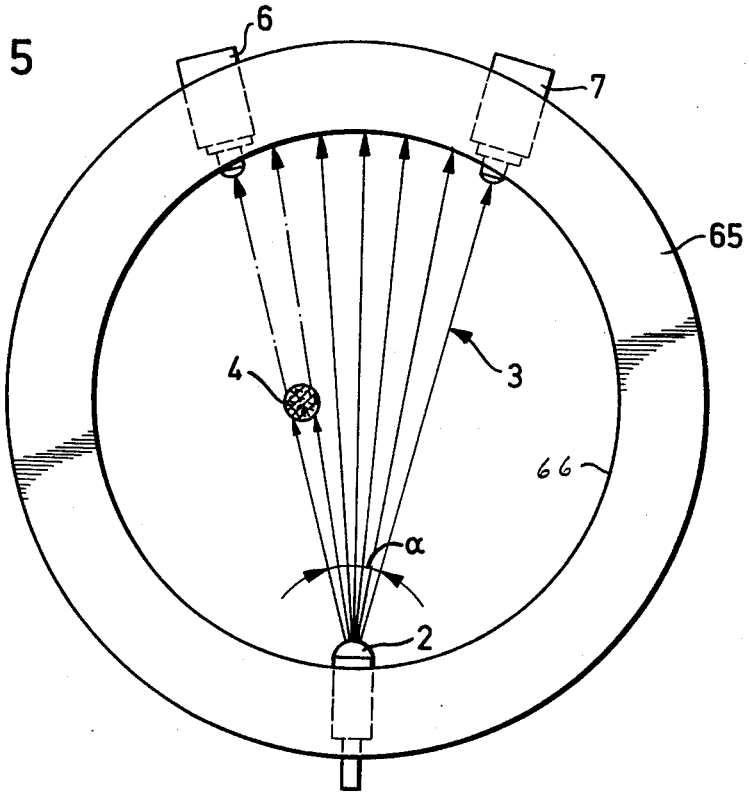
FIG. 5 illustrates an embodiment of a part of the transmitting and receiving sections.

Referring to FIG. 5, the radiation sources and detectors can be simply mounted about the weft yarn path by means of a ring 65 disposed concentrically of the weft yarn path. As shown, the ring 54 has a light-emitting diode (LED) 2 and two photocells 6, 7 disposed at the inner periphery substantially in a plane transversely of the picking direction of weft yarn 4. The diode 2 projects the light cone 3 onto the cells 6, 7 at an opening angle $\alpha$. The air used for picking flows through an aperture 66 in the ring 54 and is then discharged.

Figure 6:
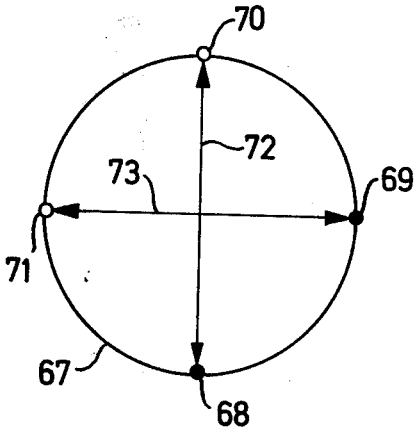
FIG. 6 illustrates a diagrammatic view of a variant of the transmitting and receiving sections according to the invention.
Figure 7:
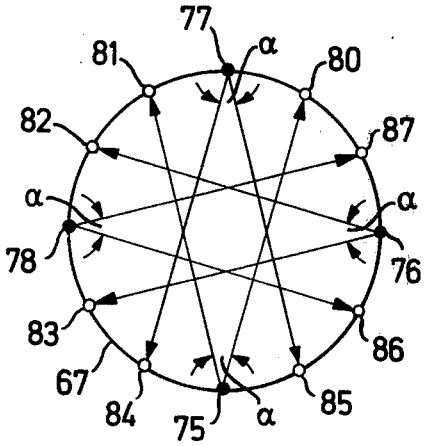
FIG. 7 illustrates another embodiment of the transmitting and receiving sections according to the invention.

Arrangements other than those shown in FIG. 5 are possible. For example, FIG. 6 diagrammatically shows a ring 67 having an arrangement of two LED's 68, 69 with two associated photocells 70, 71. LED 68, whose light cone is shown as a straight line 72, irradiates photocell 70 while LED 69 irradiates photocell 71. FIG. 7 shows an arrangement comprising four LED's and 8 photocells, two of the latter being associated with each LED. LED 76 irradiates cells 80, 81, LED 76 irradiates cells 82, 83, LED 77 irradiates cells 84, 85 and LED 78 irradiates cells 86, 87.

In all the arrangements shown, one LED can irradiate a number of photocells. If there is more than one LED, each photocell must receive only the radiation of a single LED, otherwise the interpretation of the shading or masking caused by the weft yarn becomes ambiguous.

Providing a number of LED's and photocells reduces the risk of a weft yarn moving out of the sensing or detecting radiation and failing to be detected, besides facilitating mechanical adjustment of the system.

Light-emitting diodes and photocells have been mentioned in connection with the embodiment, but other radiation sources and appropriately adapted radiation detectors can of course be used, e.g., ultrasonic radiation.

What is claimed is:

1. An opto-electronic weft yarn detector for a weaving machine having a pneumatic picking mechanism, said weft yarn detector comprising a transmitting section having at least one radiation source for directing radiation transversely of a weft yarn picking direction;

a receiving section having an even number of radiation detectors for receiving radiation from said radiation source and a difference amplifier for producing signals corresponding to the received radiation on said detectors;

an evaluator for receiving and evaluating the signals produced by said difference amplifier during a given detection time period relative to a preset value; and switching means for selectively stopping the weaving machine or operating a warning signal to stop the weaving machine, said switching means being connected to said evaluator to receive a switching signal therefrom in response to the evaluated signals falling below said preset value.

2. A weft yarn detector as set forth in claim 1 wherein said evaluator includes a second switching means and a comparator; said second switching means being connected to said comparator to periodically activate said comparator during said detection time period and said comparator being connected to said receiving section to receive and compare the number of signals produced by said difference amplifier with said preset value during said detection time period.

3. A weft yarn detector as set forth in claim 2 wherein said comparator includes a counter having a re-setting input connected to said second switching means via a single-signal sender, a counting input connected to an output of said receiving section via a first gate circuit and to said second switching means and an output connected to said first switching means via a second gate circuit.

4. A weft yarn detector as set forth in claim 1 wherein said evaluator includes a second switching means for producing a periodic signal; and a logical circuit comprising a first AND gate having one input connected to said difference amplifier to receive a signal therefrom and a second input connected to said second switching means to receive said periodic signal therefrom;

a single-signal sender having an input connected to said second switching means to receive said periodic signal therefrom;

a shift register having a shift timing input connected to an output of said first AND gate, a resetting input connected to an output of said single-signal sender and a plurality of outputs;

a preselecting circuit means for selective connection to one of said outputs of said shift register;

a second AND-gate having an input connected to an output of said preselecting circuit means; and an inverter connected between an output of said second switching means and an input of said second AND-gate.

5. A weft yarn detector as set forth in claim 1 which further comprises a ring mounting a plurality of said radiation sources and said radiation detectors on an inner periphery thereof whereby a single detector receives radiation from a single one of said sources, said ring being disposed concentrically about the weft yarn picking path.

6. A weft yarn detector as set forth in claim 5 wherein each radiation source alternates with a pair of radiation detectors about said ring.

7. An opto-electronic weft yarn detector for a weaving machine having a pneumatic picking mechanism, said weft yarn detector comprising a pair of radiation sources, each said source being disposed to direct radiation transversely of a weft yarn picking direction and in a straight line;

a pair of radiation detectors, each said detector being disposed opposite a respective one of said radiation sources for receiving radiation from said radiation sources;

a difference amplifier for producing signals corresponding to the received radiation on said detectors;

an evaluator for receiving and evaluating the signals produced by said difference amplifier during a given detection time period relative to a preset value; and switching means for selectively stopping the weaving machine or operating a warning signal to stop the weaving machine, said switching means being connected to said evaluator to receive a switching signal therefrom in response to the evaluated signals falling below said preset value.

8. A weft yarn detector as set forth in claim 1 which further comprises a ring having said radiation sources and said radiation detectors mounted thereon.

* * * * *